US006776635B2

(12) United States Patent
Blanchfield et al.

(10) Patent No.: US 6,776,635 B2
(45) Date of Patent: Aug. 17, 2004

(54) MULTI-BEAM POWER CONTACT FOR AN ELECTRICAL CONNECTOR

(75) Inventors: Michael Allen Blanchfield, Camp Hill, PA (US); Michael Stephen Garland, Manheim, PA (US); Troy Everette Conner, York, PA (US); James Charles Shiffler, Hershey, PA (US)

(73) Assignee: Tyco Electronics Corporation, Middletown, PA (US)

( * ) Notice: Subject to any disclaimer, the term of this patent is extended or adjusted under 35 U.S.C. 154(b) by 278 days.

(21) Appl. No.: 09/881,463

(22) Filed: Jun. 14, 2001

(65) Prior Publication Data

US 2002/0193019 A1 Dec. 19, 2002

(51) Int. Cl.[7] ..... H01R 13/53
(52) U.S. Cl. ..... 439/181; 439/857; 439/924.1
(58) Field of Search ..... 439/181, 857, 439/856, 924.1, 947, 825–827, 78, 79, 692

(56) References Cited

U.S. PATENT DOCUMENTS 4,734,041 A * 3/1988 Bruchmann et al. ..... 439/637
4,818,237 A 4/1989 Weber ..... 439/693
6,102,754 A * 8/2000 Capper et al. ..... 439/857
6,280,216 B1 * 8/2001 Bernier et al. ..... 439/251
6,319,075 B1 11/2001 Clark et al. ..... 439/825
6,527,590 B2 * 3/2003 Oguchi ..... 439/630

FOREIGN PATENT DOCUMENTS

EP 0 726 615 A2 8/1996
EP 0 954 063 A2 11/1999
GB 745 094 A 2/1956

* cited by examiner

*Primary Examiner*—Gary Paumeri

(57) ABSTRACT

A multi-beam power contact is provided including a main body and a plurality of at least three beams, which may be grouped in beam pairs, extending from the main body. The beams are adapted for mating with a mating connector, and the beams comprise contact areas adapted for electrical connection with the mating connector. Additionally, the multi-beam power contact may optionally include at least one initial contact beam and at least one non-initial contact beam. The initial contact beam is arranged to electrically connect to the mating connector before the non-initial contact beam electrically connects while the multi-beam power contact is being mated.

22 Claims, 6 Drawing Sheets

SECTION 5-5

MULTI-BEAM POWER CONTACT FOR AN ELECTRICAL CONNECTOR

BACKGROUND OF THE INVENTION

The preferred embodiments of the present invention generally relate to a multi-beam power contact for an electrical connector.

Connectors are used to provide temporary, detachable electrical connections between components of a system. For example, connectors may be used to help transmit electrical power in a system. As connectors are mated, the mating parts exert normal forces on each other. Stronger normal forces result in less contact resistance at the connection. Stated another way, as the normal forces exerted by two connectors on one another increase, the resistance between the connectors decreases, and visa versa. As the resistance is decreased, the current capacity of the connectors increases. Contacts may also be gold plated to reduce contact resistance. Lower contact resistance is desirable, since, as current passes through the contact, the contact will heat up more as the contact resistance level increases. The contact resistance, and resulting heating of the contact, determine the maximum amount of current that the connector is capable of carrying. However, higher normal forces, while reducing contact resistance, have the detrimental effect of increasing wear as the connector is mated and unmated, and thereby limiting the durability of the connector. Prior art contacts have had to sacrifice one of the important qualities of lower contact resistance or durability to achieve the other.

FIG. 1 illustrates an isometric view of a conventional contact 10 that includes relatively wide top and bottom beams 12 and 14 extending from the body of contact 10. The beams 12 and 14 are configured to accept a substantially flat contact from a mating connector (not shown) that fits over the top beam 12 and under the bottom beam 14 and is held in electrical contact with the top beam 12 and bottom beam 14. The contact 10 induces normal forces acting in a substantially perpendicular direction outward on a mating contact of the mating connector. The greater the normal forces, the lower the contact resistance and thus the higher the amount of current that the contact may carry. However, greater normal forces result in greater wear and less durability. Thus, the prior art design sacrifices either current carrying capability or durability.

In certain applications, contacts that carry power may be joined into a mated position while under electric load. This is referred to as hot-plugging. One example of hot-plugging occurs when computer power supply systems are exchanged. Hot plugging results in arcing which in turn damages the gold plating and erodes the base metal on contacts, which increases the contact resistance. Once the beams of the contact are damaged in this way, the contact's ability to carry current is severely limited.

It is an object of at least one preferred embodiment of the present invention to overcome the above-noted and other disadvantages of conventional power contacts.

BRIEF SUMMARY OF THE INVENTION

At least one embodiment of the present invention is provided including a multi-beam power contact. The multi-beam power contact includes a main body with a connector interface edge and a mounting edge. A plurality of at least three beams extend from the connector interface edge of the main body. The beams are adapted for mating with a mating connector, and the beams also comprise contact areas adapted for electrical connection with a mating connector. At least two of the beams may have different normal forces.

In accordance with at least one alternative embodiment, the multi-beam power contact includes a total of eight beams divided into four pairs of opposed beams that are adapted to engage opposite sides of the mating connector.

Optionally, the multi-beam power contact may also include at least one initial contact beam and at least one non-initial contact beam. The initial contact beam is arranged to electrically connect to the mating connector before the non-initial contact beam electrically connects while the multi-beam power contact is being mated. This arrangement may be accomplished by providing an initial contact beam that extends further away from the main body than other contact beams. Optionally, the longest beam may be located closest to the mounting edge of the contact.

In accordance with at least one alternative embodiment, the multi-beam power contact includes beams divided into two groups arranged along two substantially parallel planes. The beams may be aligned in a common plane and separated by a slot. The beams may also have different widths at a point of intersection with the connector interface edge. Optionally, the beams may be integral with the main body.

At least one embodiment of the present invention is provided including a power connector having a multi-beam power contact. The multi-beam power contact includes a main body with a connector interface edge and a mounting edge. The multi-beam power connector also includes a plurality of beam pairs extending from the connector interface edge. The beam pairs each comprise two beams, and the beams comprise contact areas for electrical connection. At least two of the beam pairs may have different normal forces. Further, the two beams forming a beam pair may be aligned substantially symmetric to each other.

In accordance with at least one alternative embodiment, at least one beam pair may be an initial contact beam pair and at least one beam pair may be a non-initial contact beam pair. The initial contact beam pair is arranged so that it electrically connects to a mating connector in a staged manner before the non-initial contact beam pair electrically connects when the power connector is mated to the mating connector. The staged connection arrangement may be accomplished by providing an initial contact beam pair that extends further away from the main body than a non-initial contact beam pair. Optionally, the plurality of beam pairs may comprise one initial contact beam pair and three non-initial contact beam pairs. The longest beam pair may be located closer to the mounting edge than the other beam pairs.

At least one embodiment of the present invention is provided with a power connector including a multi-beam power contact having a main body with first and second body portions having connector interface edges and mounting edges. A plurality of beam pairs extend from the connector interface edges. Beam pairs may be formed from two beams, with one beam of the beam pair extending from the first body portion and a second beam of the beam pair extending from the second body portion. Optionally, the beams forming a beam pair may be substantially symmetric to each other.

Optionally, at least one initial contact beam pair and at least one non-initial contact beam pair may be provided, with an initial contact beam pair arranged to electrically connect before a non-initial contact beam pair when the power connector is mated to a mating connector. The initial contact beam pair may extend farther away from the main body than the non-initial contact beam pair. Optionally, cross-beams may be included connecting joining edges of the first body portion and the second body portion.

Figure 1:
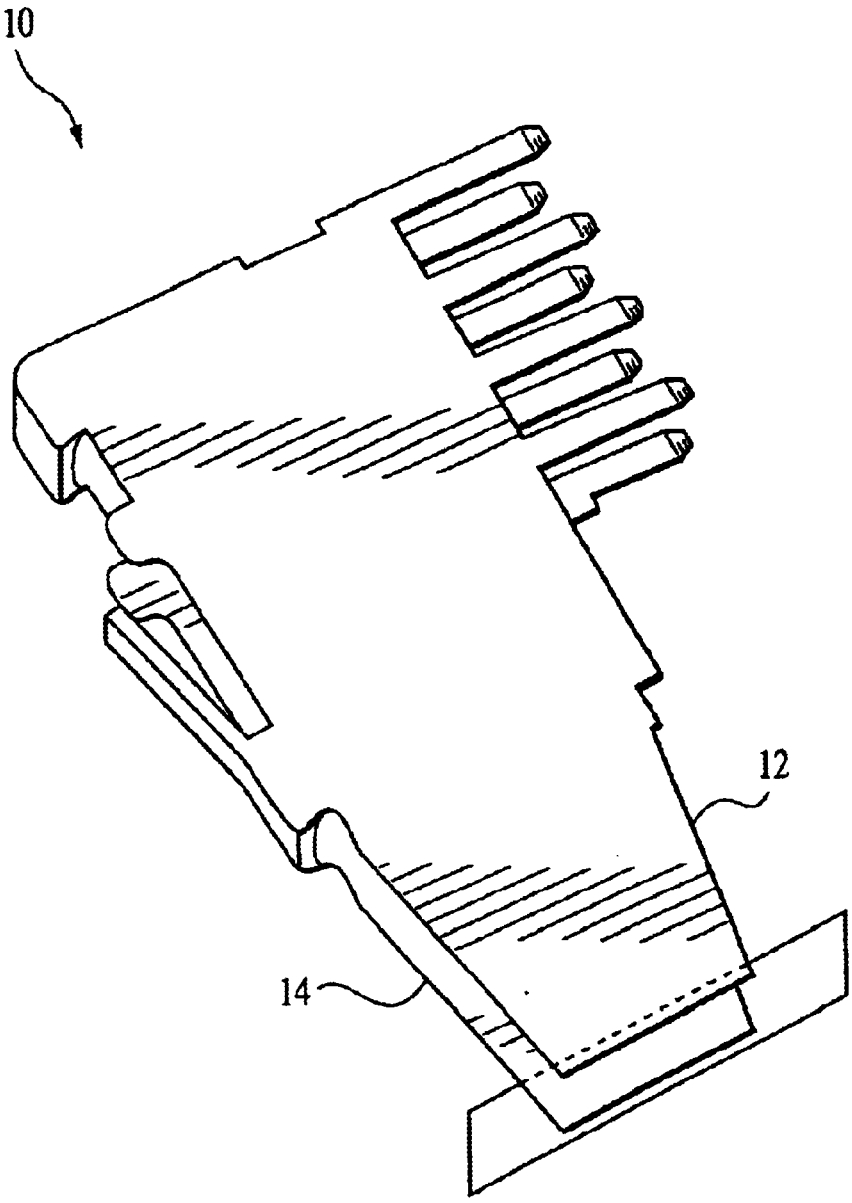
FIG. 1 illustrates an isometric view of a conventional contact.

The foregoing summary, as well as the following detailed description of the preferred embodiments of the present invention, will be better understood when read in conjunction with the appended drawings. For the purpose of illustrating the invention, there is shown in the drawings, embodiments which are presently preferred. It should be understood, however, that the present invention is not limited to the precise arrangements and instrumentality shown in the attached drawings.

DETAILED DESCRIPTION OF THE INVENTION

Figure 2:
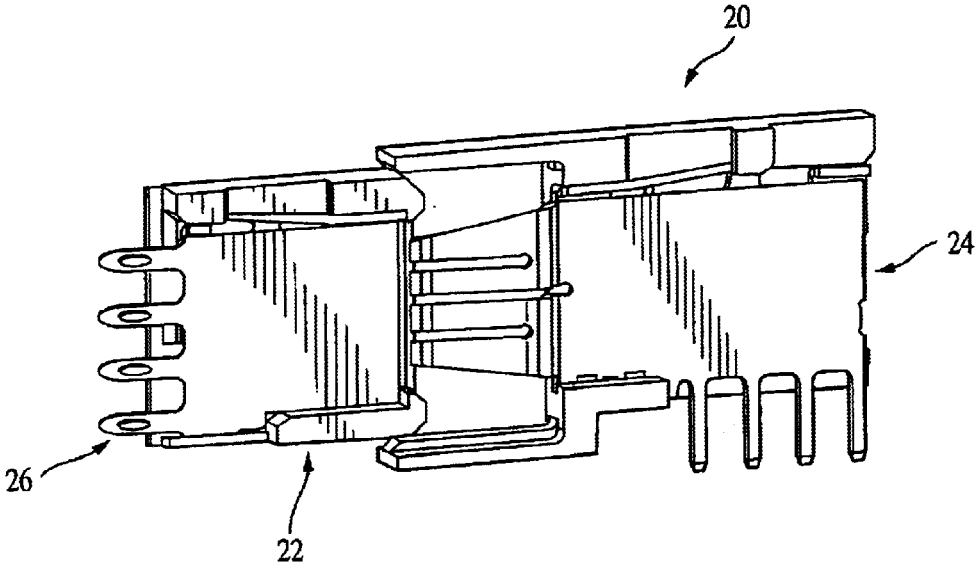
FIG. 2 illustrates an isometric view of an electrical connector with a contact formed in accordance with an embodiment of the present invention.

FIG. 2 illustrates an isometric view of an electrical connector assembly. Power connector 20 mates with mating connector 22 to provide an electrical connection. Power connector 20 comprises multi-beam power contact 24, and mating connector 22 comprises mating contact 26. When the power connector 20 and the mating connector 22 are mated, the multi-beam power contact 24 engages mating contact 26 to provide a path through which for current to flow.

Figure 3:
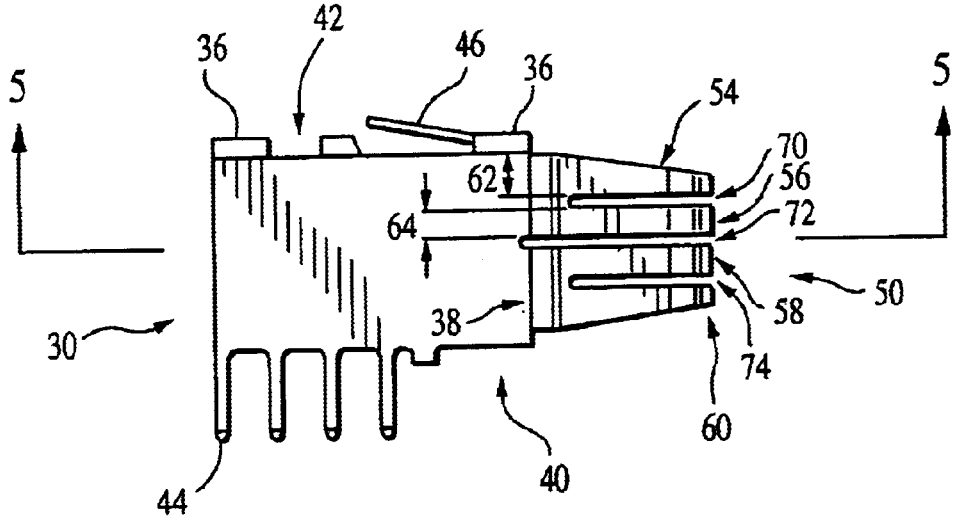
FIG. 3 illustrates a side view of a multi-beam power contact formed in accordance with an embodiment of the present invention.
Figure 4:
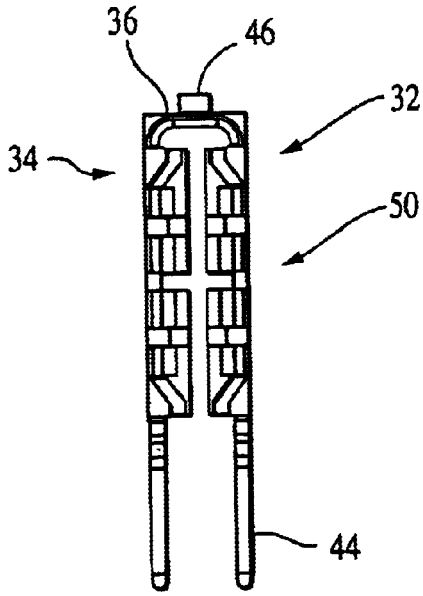
FIG. 4 illustrates a front view of a multi-beam power contact formed in accordance with an embodiment of the present invention.
Figure 5:
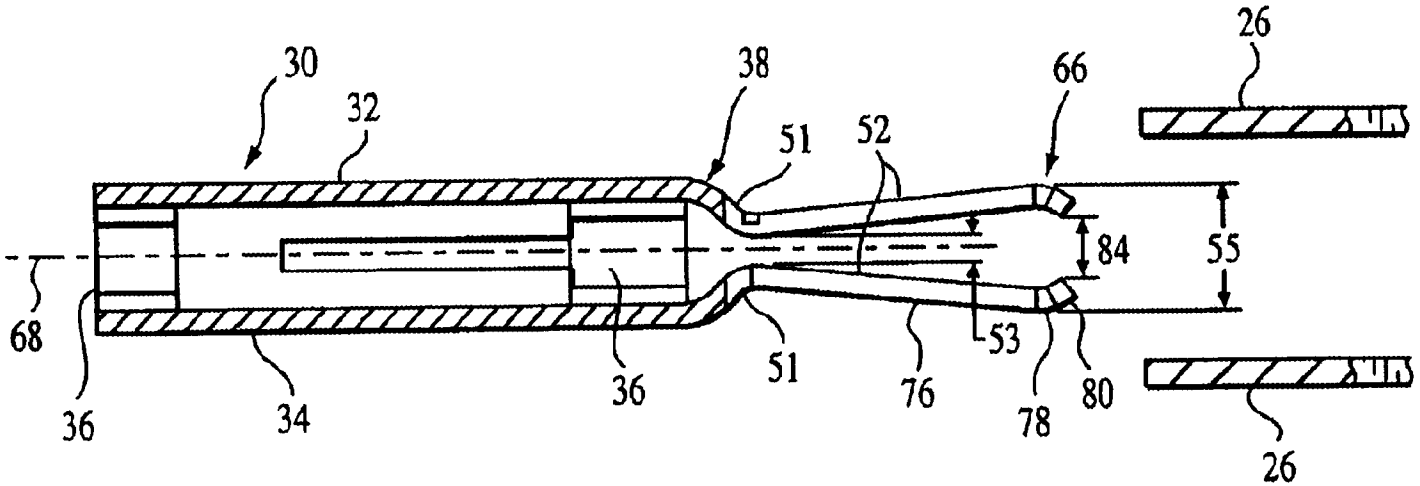
FIG. 5 illustrates a bottom sectional view of a multi-beam power contact formed in accordance with an embodiment of the present invention.

FIG. 3 illustrates a side view of a multi-beam power contact 24. FIG. 4 illustrates a front view of the multi-beam power contact 24, while FIG. 5 illustrates a top sectional view taken along line 5—5 in FIG. 3. The multi-beam power contact 24 comprises a main body 30, tails 44, beams 50 and a latch 46. Tails 44 extend from the main body 30 to facilitate a permanent connection to a component of an electrical system (not shown). The component may be, for instance, a printed circuit board and the like. The beams 50 are configured to provide for electrical contact with the mating contact 26 of the mating connector 22. While the electrical connection facilitated by the tails 44 may not be designed for frequent mating and un-mating, the connection facilitated by the beams 50 is designed to accommodate frequent mating and un-mating. The latch 46 is used for mounting and securing the multi-beam power contact 24 to the power connector 20.

As better illustrated in FIGS. 4 and 5, the main body 30 of the multi-beam power contact 24 comprises a first body portion 32, a second body portion 34, and cross-beams 36. The first body portion 32 is a substantially flat plate formed in a substantially quadrilateral shape. The second body portion 34 is also a substantially flat plated formed in a substantially quadrilateral shape. The first body portion 32 and second body portion 34 are secured by the crossbeams 36 to be substantially parallel to each other. The first body portion 32 and second body portion 34 define a central plane 68 which is substantially parallel to and equidistant from the first body portion 32 and second body portion 34. The first body portion 32 and the second body portion 34 are held substantially symmetric to each other about the central plane 68 by the cross-beams 36.

The main body 30 (as well as the first body portion 32 and second body portion 34) comprise a connector interface edge 38, a mounting edge 40 and a joining edge 42. The tails 44 are proximal to and extend from the mounting edge 40. The connector interface edge 38 is mounted adjacent to and aligned substantially perpendicular to the mounting edge 40. The joining edge 42 is formed adjacent to the connector interface edge 38 and opposite the mounting edge 40. The cross-beams 36 join the first body portion 32 and the second body portion 34 at the mounting edge 40. One of the cross-beams 36 may be located proximal to the connector interface edge 38 to hold the first and second body portions 32 and 34 a desired distance from one another, even when a mating connector 22 is inserted.

The beams 50 extend from the connector interface edges 38 of the main body 30. By way of example only, four beams 50 may extend from the first body portion 32, and four beams 50 may extend from the second body portion 34. The beams 50 extending from the first body portion 32 may be formed substantially co-planar to each other as well as to the first body portion 32. The beams 50 may be slightly bent and are therefore not absolutely co-planar. Similarly, the beams 50 extending from the second body portion 34 may be formed substantially co-planar to each other as well as to the second body portion 34.

The beams 50 are grouped into beam pairs 52 (FIG. 5). Each beam pair 52 comprises a beam 50 extending from the first body portion 32 and a beam 50 extending from the second body portion 34. The beams 50 in each beam pair 52 are generally located opposite one another. The two beams 50 defining a beam pair 52 are aligned substantially symmetric to each other about the central plane 68. As shown in FIG. 3, the multi-beam power contact 24 comprises a first beam pair 54, a second beam pair 56, a third beam pair 58, and a fourth beam pair 60.

The first beam pair 54 is located proximal to the joining edge 42. The second beam pair 56 is located adjacent to the first beam pair 54. A first slot 70 is interposed between the first beam pair 54 and the second beam pair 56. The third beam pair 58 is located adjacent to the second beam pair 56. A second slot 72 is interposed between the second beam pair 56 and the third beam pair 58. The fourth beam pair 60 is located adjacent to the third beam pair 58 and proximal to the mounting edge 40. A third slot 74 is interposed between the third beam pair 58 and the fourth beam pair 60.

As show in FIG. 5., each beam 50 comprises a first beam portion 76, a contact interface portion 78, and a second beam portion 80, all formed integral with one another, but shaped in a zig-zag pattern. The first beam portion 76 projects from the connector interface edge 38, and is merged into the second beam portion 80 at the contact interface portion 78.

The first beam portions 76 of the beams 50 of the first beam pair 54 define a generally trapezoidal shape. A first width 62 is defined at the intersection of the beams 50 of the first beam pair 54 with the main body 30 at the connector interface edge 38. As the beams 50 extend further from the main body 30, the width of the beams 50 of the first beam pair 54 narrows, giving the first beam portions 76 of the first beam pair 54 their generally trapezoidal shape. The geometry of the first beam portions 76 of the fourth beam pair 62 is substantially similar to the geometry of the first beam portions 76 of the first beam pair 54. However, the first beam portions 76 of the first beam pair 54 taper away from the joining edge 42, whereas the first beam portions 76 of the fourth beam pair 62 taper away from the mounting edge 40.

The first beam portions 76 of the second and third beam pairs 56 and 58 include a generally quadrilateral shape with a second width 64 at the intersection of the beams 50 of the second and third beam pairs 56 and 58 with the main body 30 at the connector interface edge 38. The second width 64 is less than the first width 62.

FIG. 5 illustrates a top view of a multi-beam power contact 24. As described above, each of the beams 50 comprises an elbow 51, a first beam portion 76, a contact interface portion 78, and a second beam portion 80. The first beam portion 76 is located proximal to the main body 30 at the connector interface edge 38 and extends from the elbow 51 away from the main body 30. As the first beam portion 76 extends away from the main body 30, the first beam portion 76 also extends away from the central plane 68, until the first beam portion 76 terminates at the contact interface portion 78, where the first beam portion 76 is connected with the second beam portion 80. As the second beam portion 80 extends away from the main body 30, the second beam portion 80 extends closer to the central plane 68. The second beam portions 80 define a gap 84. The beam portions 78 and 80 comprise contact areas 66 for electrically connecting with the mating contact 26 of the mating connector 22.

The elbows 51 of a beam pair 52 are spaced apart by a gap 53, while the contact interface portions 78 of the same beam pair 52 are spaced apart by a greater distance 55. The gap 84 is less than distance 55, but may be approximately the same as the gap 53.

When the power connector 20 is mated to the mating connector 22, the beam pairs 52 are accepted by the mating contact 26 of the mating connector 22. The contact interface portions 78 form electrical connections with the mating contact 26. The mating contact 26 contacts the multi-beam power contact 24, thereby urging the beams 50 forming a beam pair 52 together. The beams 50 exert a normal force through the contact interface portions 78 in a direction substantially perpendicular to the central plane 68 to counteract the urging together caused by mating. The zig-zag or "S" shape of the beams 50 facilitate the exertion of a desired normal force at the contact interface portions 78.

The magnitude of the normal force is dependent on the structure of the beams 50. The more rigid the beams 50, the greater the normal force. The beams 50 may have substantially similar cross-sectional thicknesses, while the first width 62 of the beams 50 forming the first and fourth beam pairs 54 and 60 may be greater than the second width 64 of the beams 50 forming the second and third beam pairs 56 and 58. Consequently, the normal force exerted by the beams 50 of the first beam pair 54 and the fourth beam pair 60 may be greater than the normal force exerted by the beams 50 of the second beam pair 56 and third beam pair 58. Further, the beams 50 of the first beam pair 54 are located proximal to the joining edge 42 and thus the spacing therebetween is better supported by the cross-beams 36 than for example the beams 50 of the fourth beam pair 60. Thus, the beams 50 of the first beam pair 54 may exert a greater normal force than the beams 50 of the fourth beam pair 60.

Figure 6:
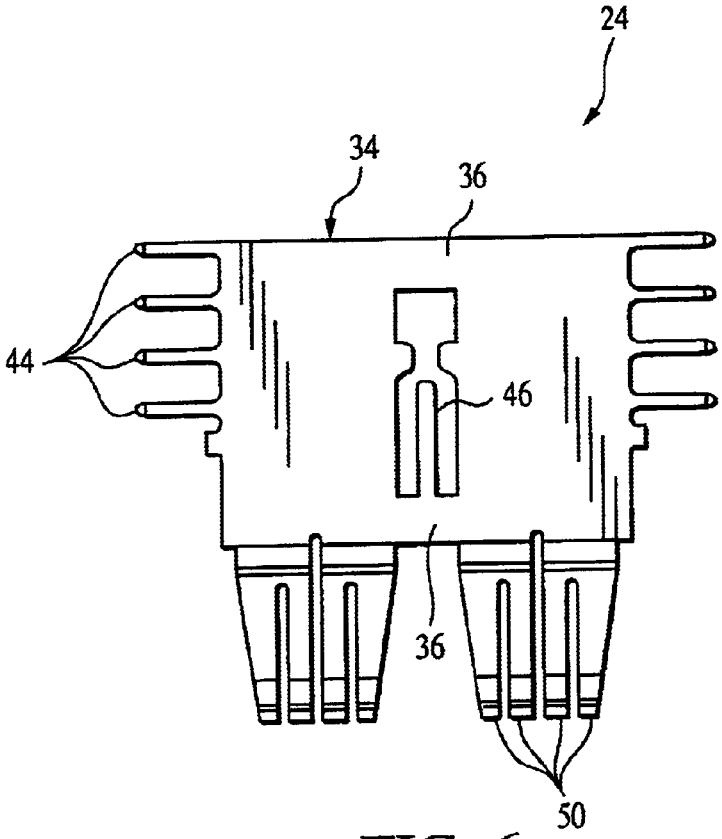
FIG. 6 illustrates a side view of a multi-beam power contact before final assembly formed in accordance with an embodiment of the present invention.
Figure 7:
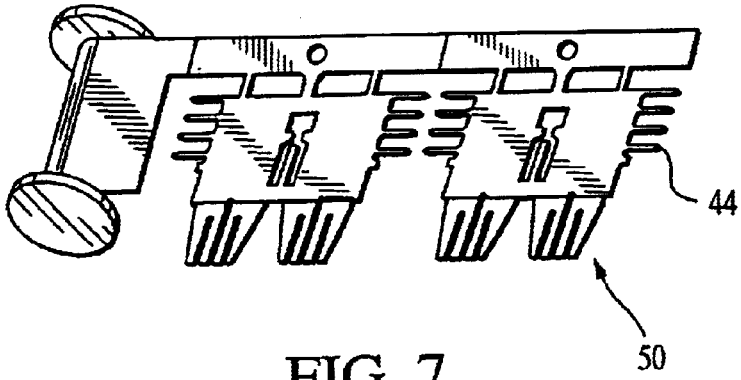
FIG. 7 illustrates an isometric view of a multi-beam power contact before final assembly formed in accordance with an embodiment of the present invention.

The first body portion 32, second body portion 34, cross-beams 36, connectors 44, latch 46, and beams 50 may be integral with each other, such as by stamping or cutting the multi-beam power contact 24 from a single piece of material. FIGS. 6 and 7 illustrate a single piece of material stamped in a desired pattern, but not yet bent to form a multi-beam power contact 24. To form the multi-beam power contact 24, the multi-beam power contact 24 may be stamped in the shape shown in FIGS. 6 and 7, and then the beams 50 bent to a desired shape. Then the multi-beam power contact 24 may then be bent at the junction of the cross-beams 36 and the first body portion 32, so that the first body portion 32 is substantially perpendicular to the cross-beams 36. The multi-beam power contact 24 may also be bent at the junction of the cross-beams 36 and second body portion 34 so that the second body portion 34 is substantially perpendicular to the cross-beams 36 and substantially parallel and opposed to the first body portion 32.

The use of multiple beams 50 provides a power contact that achieves both high current carrying capability and long durability. By providing multiple points of contact and paths through which electricity may flow, the multi-beam power contact 24 provides for increased current carrying capability at smaller normal forces, thereby improving durability. The normal force acting on individual beams 50 in the multi-beam power contact 24 is less than that of prior contacts, as the force is distributed among more than one adjacent beam. The design of the beams may also be varied to adjust the normal force by, for example, varying beam geometry, beam thickness, beam width, and/or depth of the slots.

Optionally, the shape and curvature of individual beams may be varied from other beams in the same contact to provide a range of normal forces, providing a design in which some beams provide greater normal force and less contact resistance, while other beams provide less normal force and improved durability. The use of multiple beams further provides redundancy in the design. If a beam becomes damaged, the remaining beams still carry current, thereby further improving durability and reliability. Lower normal forces are required to carry current in the multi-beam power contact, so a connector featuring the multi-beam contact not only will experience less wear, but also will be easier to connect and disconnect from a mating connector. Additionally, if the connectors are joined in a cocked or misaligned fashion, the multi-beam power contact provides multiple surfaces to help equalize any resulting variance in current distribution.

Figure 8:
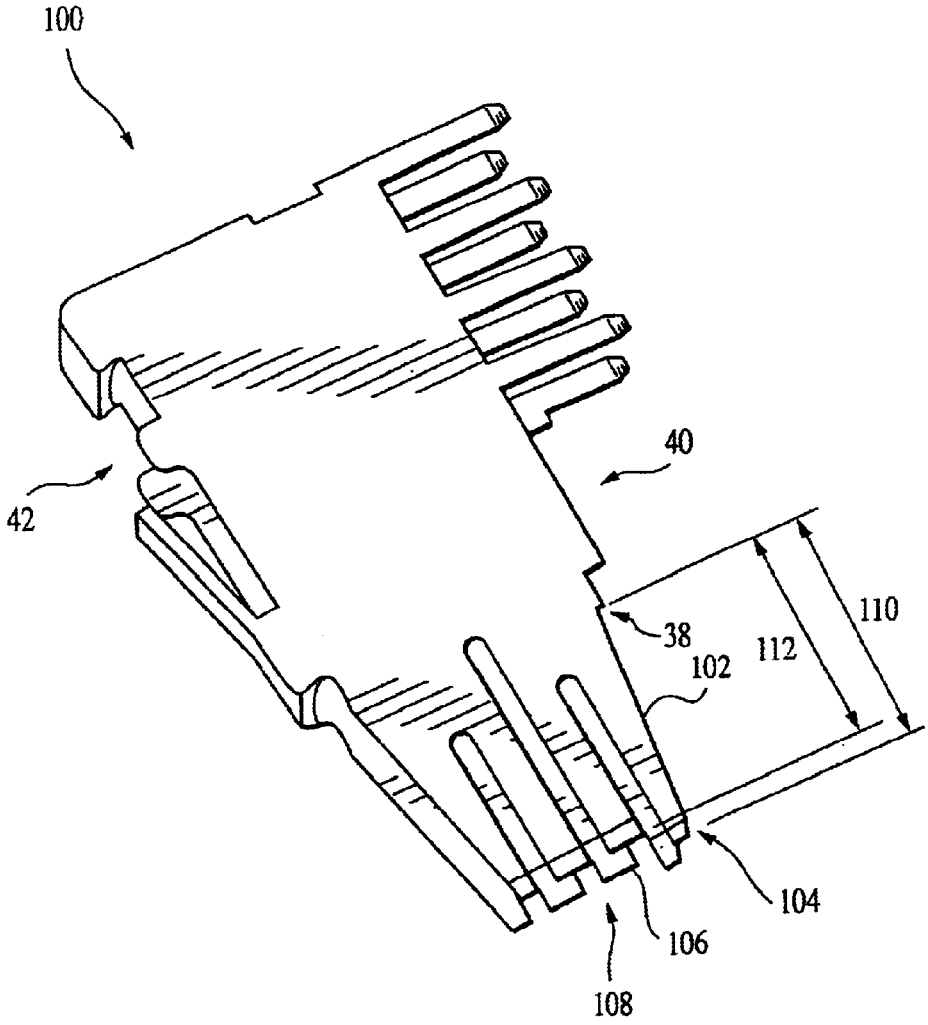
FIG. 8 illustrates an isometric view of a multi-beam power contact with an initial contact beam formed in accordance with an embodiment of the present invention.

FIG. 8 illustrates an isometric view of another embodiment of a multi-beam power contact 100. The multi-beam power contact 100 is similar to the previously discussed multi-beam power contact 24 in some respects. For example, the multi-beam power contact 100 comprises a main body 30 with a connector interface edge 38, beams 50 and tails 44.

The multi-beam power contact 100 comprises two initial contact beams 102 forming an initial contact beam pair 104. In the illustrated embodiment, the initial contact beam pair 104 is located closer to the mounting edge 40 than the non-initial contact beam pairs 108. Optionally, the initial contact beam pair 104 may be located elsewhere on the multi-beam power contact 100 among the non-initial contact beampairs 108. The initial contact beam pair 104 extends a first length 110 from the connector interface edge 38 of the main body 30. The multi-beam power contact 100 also comprises non-initial contact beams 106 which form non-initial contact beam pairs 108. The non-initial contact beam pairs 108 extend a second length 112 from the connector interface edge 38 of the main body 30. The first length 110 of the initial contact beam pair 104 is greater than the second length 112 of the non-initial contact beam pairs 108. Thus, during a mating operation, the initial contact beam pair 104 is electrically connected to a mating contact 26 before the non-initial contact beam pairs 108.

Multi-beam power contact 100 is well adapted for hot plugging applications. Because the initial contact beam pair 104 becomes electrically connected before the non-initial contact beam pairs 106, any arcing occurring during hot plugging operation is limited to the initial contact beam pair 104. Thus, the non-initial contact beam pairs 108 will experience less damage due to arcing. Even if the initial contact beam pair 104 is damaged by arcing, the non-initial contact beam pairs 108 still provide adequate conductivity, and the multi-beam power contact 100 can be used in repeated connections, even in hot plugging applications.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. A one piece power connector comprising:

a main body having a connector interface edge and a mounting edge;

a plurality of beam pairs extending from said connector interface edge of said main body;

each of said beam pairs comprising two beams; that are opposed to each other each of said beams said beams having a contact area for electrical connection;

wherein at least one of said beam pairs is an initial contact beam pair and at least one of said beam pairs is a non-initial contact beam pair; and wherein the contact areas of said at least one initial contact beam pair are arranged to electrically connect to a mating connector before the contact areas of said at least one non-initial contact beam pair electrically connect to the mating connector when said power connector is mated to the mating connector.

2. The one piece power connector of claim 1, wherein at least two of said beam pairs have different normal forces within a range of normal forces.

3. The one piece connector of claim 1, wherein said two beams of each said beam pair are substantially symmetric to each other.

4. The one piece power connector of claim 1, wherein said at least one initial contact beam pair extends further from said main body than said at least one non-initial contact beam pair.

5. The one piece connector of claim 1, wherein said plurality of beam pairs comprise at total of one said initial contact beam pair and at least two said non-initial contact beam pairs.

6. The one piece power connector of claim 1, wherein said beams are divided into two groups of beams arranged along two substantially parallel planes.

7. The one piece power connector of claim 1, wherein at least two of said beams are aligned in a common plane and separated by a slot.

8. The one piece power connector of claim 1, wherein at least two of said beams are aligned in a common plane and have different widths at a point of intersection with said connector interface edge.

9. The one piece power connector of claim 1, wherein at least one said beam pair has a length greater than a length of an adjacent said beam pair.

10. The one piece power connector of claim 1, wherein a said beam pair closest to said mounting edge is longer than any other said beam.

11. A one piece power connector comprising:

a main body comprising a first body portion and a second body portion;

each of said first and second body portions including a connector interface edge and a mounting edge;

a plurality of beam pairs extending from said connector interface edges of said first and second body portions;

each of said beam pairs comprising two beams; that one opposed to each other each of said beams having a contact area for electrical connection;

wherein at least one of said beam pairs is an initial contact beam pair and at least one of said beam pairs is a non-initial contact beam pair; and wherein the contact areas of said at least one initial contact beam pair are arranged to electrically connect to a mating connector before the contact areas of said at least one non-initial contact beam pair electrically connect to the mating connector while said power connector is mated to said mating connector.

12. The one piece power connector of claim 11, wherein at least two of said beam pairs have different normal forces within a range of normal forces.

13. The one piece power connector of claim 11, wherein said two beams of each said beam pair are substantially symmetric to each other.

14. The one piece power connector of claim 11, wherein said at least one initial contact beam pair extends further from said main body than said at least one non-initial contact beam pair.

15. The one piece power connector of claim 11, wherein said plurality of beam pairs comprise a total of one said initial contact beam pair and three said non-initial contact beam pairs.

16. The one piece power connector of claim 11, wherein said main body comprises cross-beams connecting edges of said first and second body portions; and one of said cross-beams is located proximal to said connector interface edges.

17. A one piece power connector comprising:

a main body having a connector interface edge and a mounting edge;

a plurality of beam pairs extending from said connector interface edge of said main body;

said beam pairs each comprising two beams; that one opposed to each other said beams comprising contact areas for electrical connection;

at least one of said beam pairs being an initial contact beam pair and at least one of said beam pairs being a non-initial contact beam pair; and said contact areas of said at least one initial contact beam pair being arranged to electrically connect to a mating connector before the contact areas of said at least one non-initial contact beam pair electrically connect to the mating connector while said power connector is mated to the mating connector.

18. The one piece power connector of claim 17, wherein said beams are divided into two groups of beams arranged along two substantially parallel planes.

19. The one piece power connector of claim 17, wherein at least two of said beams are aligned in a common plane and separated by a slot.

20. The one piece power connector of claim 17, wherein at least two of said beams are aligned in a common plane and have different widths at a point of intersection with said connector interface edge.

21. The one piece power connector of claim 17, wherein at least one beam has a length greater than a length of an adjacent beam.

22. The one piece power connector of claim 17, wherein a beam pair closest to said mounting edge is longer than any other beam pair.

* * * * *